US005477835A

United States Patent [19]

Nuti

[11] Patent Number: 5,477,835

[45] Date of Patent: Dec. 26, 1995

[54] COMPACT CYLINDER HEAD ARRANGEMENT FOR INTERNAL COMBUSTION ENGINES, IN PARTICULAR WITH TWO CYLINDERS

[75] Inventor: Marco Nuti, Pisa, Italy

[73] Assignee: Piaggio Veicoli Europei S.p.A., Italy

[21] Appl. No.: 380,711

[22] Filed: Jan. 30, 1995

[30] Foreign Application Priority Data

Feb. 2, 1994 [IT] Italy ..... MI94A0183

[51] Int. Cl.[6] ..... F02M 37/04

[52] U.S. Cl. ..... 123/509

[58] Field of Search ..... 123/508, 509, 123/190.1, 193.5

[56] References Cited

U.S. PATENT DOCUMENTS

| | | | |
|---|---|---|---|
| 4,007,725 | 2/1977 | Wraver | 123/190.1 |
| 4,522,182 | 6/1985 | Mowbray | 123/509 |
| 4,660,522 | 4/1987 | Babizka | 123/509 |
| 5,007,401 | 4/1991 | Grohn et al. | 123/509 |
| 5,233,952 | 8/1993 | Isaka | 123/509 |

FOREIGN PATENT DOCUMENTS

| | | |
|---|---|---|
| 0451466 | 2/1991 | European Pat. Off. . |
| 0514982 | 5/1992 | European Pat. Off. . |

*Primary Examiner*—Thomas N. Moulis
*Attorney, Agent, or Firm*—Diller, Ramik & Wight

[57] ABSTRACT

A compact cylinder head arrangement (11) for internal combustion engines, in particular with two cylinders, comprising at least one pair of cylinders provided with a valve aperture (53) and relative valve (56), there being associated with each cylinder a chamber (14, 15) which at one end is connected to the valve (56) and at the other end is connected to means for feeding a fuel mixture, within each chamber (14, 15) there being provided a piston (17, 18) for injecting a mixture generated within the chamber (14, 15) into the respective cylinder, the pistons (17, 18) being moved by a connecting rod (23) driven by a positive transmission (44, 47) operated by a drive shaft, each piston connecting rod (23) being rotatably pivoted on a shaft element (24, 25, 26) rotating within a bush (31) retained in the cylinder head (11) and rigidly connected to the positive transmission, the shaft element and the bush being provided with fuel mixture feed ducts (33, 34, 35) which are alternately alignable during the rotation of the shaft element (24, 25, 26).

10 Claims, 1 Drawing Sheet

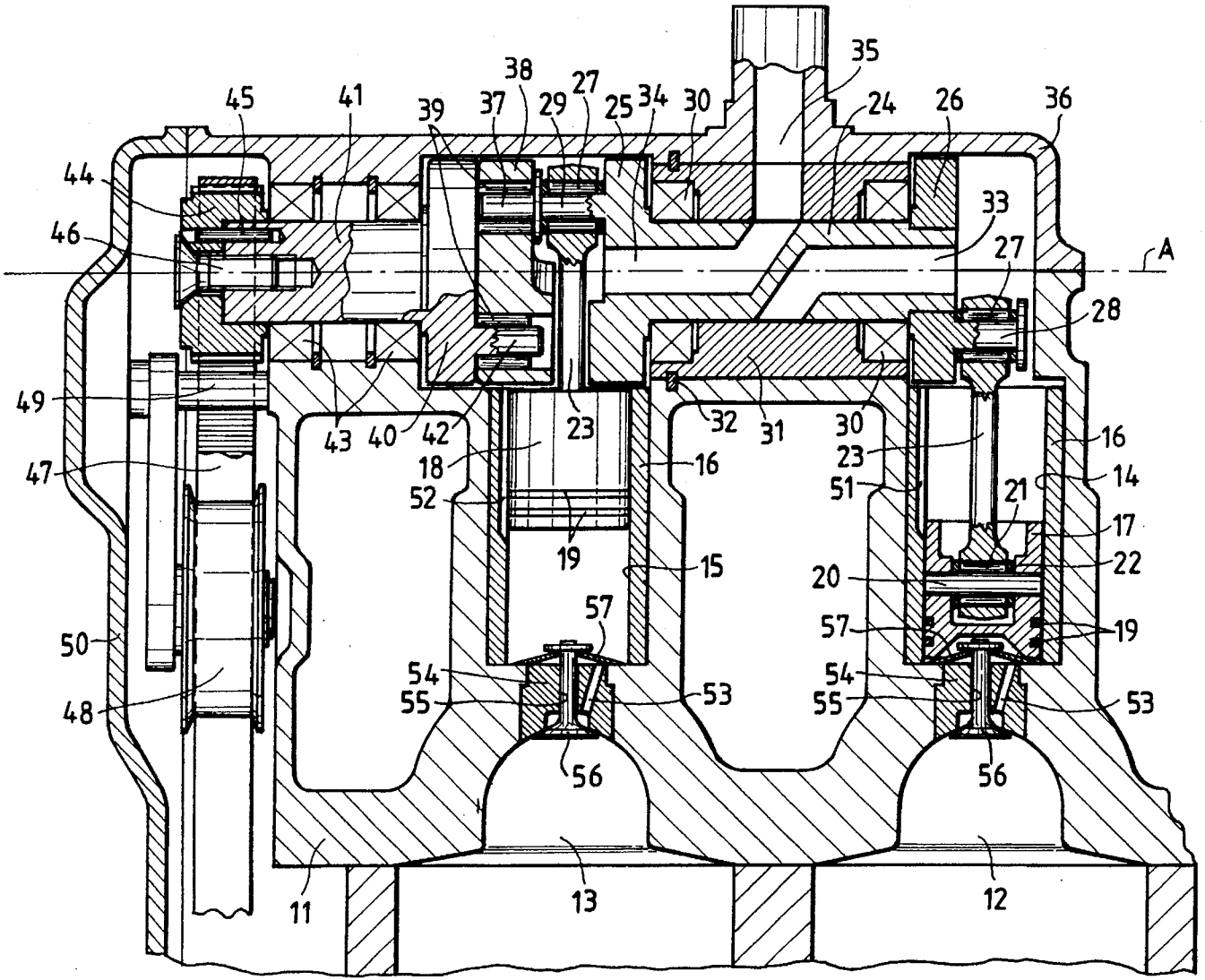
A
36
28
16
14
17
22
19
53
33
27
21
56
12
26
24
35
30
23
51
20
57
54
55
31
32
16
15
53
30
34
25
27
29
38
37
39
23
19
57
56
13
42
18
52
54
55
40
41
43
11
45
44
46
49
47
50
48

COMPACT CYLINDER HEAD ARRANGEMENT FOR INTERNAL COMBUSTION ENGINES, IN PARTICULAR WITH TWO CYLINDERS

This invention relates to a compact cylinder head arrangement for internal combustion engines, in particular with two cylinders. Various systems are currently used for pneumatically assisted direct fuel injection into the cylinder head of an internal combustion engine, such as those described for example in European patent EP-A-514 982 in the name of the present applicant. These systems are very valid if combined with a properly sized structure of extreme constructional simplicity, which however cylinder heads currently do not possess. The need for this is particularly felt in two-stroke engines, such as those intended for boat propulsion, in particular outboard motors. The object of the present invention is to provide a cylinder head arrangement which satisfies these requirements by being particularly compact and simple, in addition to being usable in a multiplicity of different applications.

This object is attained according to the present invention by a compact cylinder head arrangement for internal combustion engines, in particular with two cylinders, comprising at least one pair of cylinders provided with a valve aperture and relative valve, there being associated with each cylinder a chamber which at one end is connected to said valve and at the other end is connected to means for feeding a fuel mixture, within each chamber there being provided a piston for injecting a mixture generated within said chamber into the respective cylinder, said pistons being moved by a connecting rod driven by a positive transmission operated by a drive shaft, characterised in that each connecting rod of said pistons is rotatably pivoted on a shaft element rotating within a bush retained in said cylinder head and rigidly connected to said positive transmission, said shaft element and said bush being provided with feed ducts for said fuel mixture which are alternately alignable during the rotation of said shaft element. Such an arrangement is also particularly advantageous for application to engines for vehicles or for stationary use in general.

The characteristics and advantages of a compact cylinder head arrangement for internal combustion engines, in particular two cylinder engines, according to the present invention will be more apparent from the description given hereinafter by way of non-limiting example with reference to the accompanying schematic drawing.

This drawing represents an at least partial section through a cylinder for a two cylinder engine in which the arrangement according to the present invention is used in the presence of devices for pneumatically assisted direct fuel feed into the relative cylinders.

The FIGURE shows a two-cylinder head, indicated overall by 11, comprising two combustion chambers 12 and 13 above which there are provided two chambers 14 and 15, of cylindrical type, containing two essentially cylindrical jackets 16.

Two injection pistons 17 and 18 provided with piston rings 19 are arranged within the two chambers 14 and 15 and slidable on the jackets 16. The two pistons 17 and 18 are connected to relative connecting rods 23 via relative gudgeons 20, roller bearings 21 and shoulder spacers 22, these being shown only in one piston. The connecting rods 23 are connected to a shaft element driven by a drive shaft, not shown. Specifically, the shaft element comprises a central cylindrical rotating body 24 with two flanged ends 25 and 26 of wider diameter, for example one 25 being formed integral with the central body 24 and the other 26 being forced thereon.

The free ends of the two connecting rods 23 are connected to said two flanged ends 25 and 26 via roller bearings 27 and two pins 28 and 29. The shaft element, ie its central body 24, is rotatably arranged on two end bearings 30 located within a bush 31 secured to the cylinder head 11 by a split ring 32. In the central body 24 and in the two flanged ends 25 and 26 there are provided two ducts 33 and 34 which open into the upper parts of the two chambers 14 and 15. The two ducts 33 and 34 extend partly axially along the axis of rotation A of the shaft element and partly inclined, they being mutually offset by 180° . In this manner they provide passage for the mixture originating from a single feed duct 35 provided partly in the bush 31 and partly in a cover element 36 for the cylinder head 11. The mixture is introduced into the fuel feed ducts 33 and 34, which are alternately alignable during the rotation of the shaft element 24, 25 and 26 with the fixed ducts 35 provided in the bush 31 and in the cover element 36. The mixture can be prepared by a carburator or by other elements, not shown, and fed to the aforesaid fuel feed means.

The pin 29 of the connecting rod 23 of the second injection piston 18 extends axially in the form of a prolongation 37 which engages in a coupling element 38. This engagement is via an interposed roller bearing 39, the coupling element 38 being engaged with a flanged end 40 of a control shaft 41 via a further pin 42 with relative roller bearing 39.

The control shaft 41, which rotates on bearings 43, is rigidly connected at its other end to a toothed pulley 44 by an angular reference pin 45 and a locking screw 46.

As in other cases, a toothed transmission belt 47, driven synchronously by the drive shaft, not shown, operates the control shaft 41. A tensioning element, indicated schematically at 48, is also usually provided pivoted at 49 to the cylinder head 11. As stated, the cylinder head 11 is upperly closed by the cover element 36, the toothed belt 47 being contained within a laterally extending protection element 50.

In conjunction with the suction created in the cover element 36, the rotating shaft element 24, 25 and 26 enables rich mixture to be drawn into the chambers 14 and 15.

The mixture is then transferred into the relative compression chambers below the pistons 17 and 18 via transfer ducts 51 and 52 respectively, such as concave lateral portions recessed into the jackets 16.

The lower ends of the chambers 14 and 15 are provided with apertures 53 located in end closure elements 54 housing valve seats 55.

Mushroom valves 56 are provided which when in their rest position close said apertures 53 in collaboration with spoke springs 57 positioned coaxially with them and suitably rated. An arrangement according to the present invention, which can also be used for multi-cylinder internal combustion engines, is particularly advantageous in two-cylinder engines.

In this respect a considerable compactness is achieved by virtue of the location of the various components, while preserving considerable simplicity of construction and assembly. The operation of such an arrangement in an internal combustion engine cylinder head is apparent and is merely summarized hereinafter.

The mixture is fed via the duct 35 provided in the cover element 36 and bush 31 fixed to the cylinder head 11. The mixture passes alternately through the ducts 33 and 34, which as the shaft element 24–26 rotates become aligned with the fixed duct 35, to penetrate into the respective chambers 14 and 15.

As the shaft element rotates it causes the pistons 17 and 18 to move by means of the connecting rods 23, with consequent compression of the mixture which has passed from the transfer ducts 51 and 52 to the underlying compression region. The injection pistons 17 and 18 selectively inject the mixture into the underlying combustion chambers 12 and 13 via the valves 56. The arrangement according to the invention enables a compact cylinder head to be formed by virtue of the particular construction of the shaft element, the connection elements with the positive transmission and the ducts.

The structure of the shaft element with a central portion 24 and two flanged ends 25 and 26 allows easy location of the pins 28 and 29 for its rotation and mutual connection to the connecting rods 23. In addition by simply extending at 37 one of the two pins 29, coupling with the control shaft 41 is achieved in an extremely simple manner.

The cylinder head is therefore of unusual compactness and offers considerable constructional advantages.

I claim:

1. A compact cylinder head arrangement (11) for internal combustion engines, in particular with two cylinders, comprising at least one pair of cylinders provided with a valve aperture (53) and relative valve (56), there being associated with each cylinder a chamber (14, 15) which at one end is connected to said valve (56) and at the other end is connected to means for feeding a fuel mixture, within each chamber (14, 15) there being provided a piston (17, 18) for injecting a mixture generated within said chamber (14, 15) into the respective cylinder, said pistons (17, 18) being moved by a connecting rod (23) driven by a positive transmission (44, 47) operated by a drive shaft, characterised in that each connecting rod (53) of said pistons (17, 18) is rotatably pivoted on a shaft element (24, 25, 26) rotating within a bush (31) retained in said cylinder head (11) and rigidly connected to said positive transmission (44, 47), said shaft element (54, 25, 26) and said bush (31) being provided with fuel mixture feed ducts (33, 34, 35) which are alternately alignable during the rotation of said shaft element (24, 25, 26).

2. A compact cylinder head arrangement as claimed in claim 1, characterised in that said shaft element comprises a central cylindrical rotating body (24) having two wider-diameter flanged ends (25, 26), to which said connecting rods (23) are pivoted.

3. A compact cylinder head arrangement as claimed in claim 2, characterised in that one (25) of said flanged ends is formed integrally with said central body (54) and the other end (56) is forced thereon.

4. A compact cylinder head arrangement as claimed in claim 1, characterised in that said connecting rods (23) are connected to ends (25, 26) of said shaft element via roller bearings (27) and relative pins (28, 29), at least two end bearings (30) being provided between said bush (31) and said shaft element (24, 25, 26).

5. A compact cylinder head arrangement as claimed in claim 1, characterised in that the bush (31) is secured to said cylinder head (11) by at least one split ring (32).

6. A compact cylinder head arrangement as claimed in claim 1, characterised in that said ducts (33, 34) provided in said shaft element have a partly axial and a partly inclined extension and are mutually offset by 180°, they being alternately alignable with ducts (35) provided partly in said bush (31) and partly in a cover element (36) for said cylinder head (11).

7. A compact cylinder head arrangement as claimed in claim 1, characterised in that said shaft element (24, 25, 26) is connected via a coupling element (38) to a control shaft (41) rigid with said positive transmission (44, 47).

8. A compact cylinder head arrangement as claimed in claim 7, characterised in that said shaft element (24, 25, 26) is connected to said coupling element (38) by an axial prolongation (37) of a pin (29) of one of said connecting rods (23).

9. A compact cylinder head arrangement as claimed in claim 7, characterised in that said coupling element (38) is engaged with a flanged end (40) of said control shaft (41) by a further pin (42).

10. A compact cylinder head arrangement as claimed in claim 7, characterised in that said positive transmission comprises a toothed pulley (44) securely fixed to said control shaft (41) and operated by a toothed belt (47) driven by a drive shaft.

* * * * *